US011053636B2

(12) United States Patent
Nam et al.

(10) Patent No.: US 11,053,636 B2
(45) Date of Patent: Jul. 6, 2021

(54) CLOTHES TREATING APPARATUS

(71) Applicant: LG ELECTRONICS INC., Seoul (KR)

(72) Inventors: Wansik Nam, Seoul (KR); Donghyun Kim, Seoul (KR); Jinseong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 362 days.

(21) Appl. No.: 15/950,743

(22) Filed: Apr. 11, 2018

(65) Prior Publication Data

US 2018/0298549 A1 Oct. 18, 2018

(30) Foreign Application Priority Data

Apr. 14, 2017 (KR) ..... 10-2017-0048719

(51) Int. Cl.
*D06F 73/02* (2006.01)
*D06F 58/10* (2006.01)
*D06F 39/00* (2020.01)

(52) U.S. Cl.
CPC ..... *D06F 73/02* (2013.01); *D06F 39/008* (2013.01); *D06F 58/10* (2013.01); *D06F 2202/085* (2013.01); *D06F 2204/04* (2013.01); *D06F 2204/086* (2013.01)

(58) Field of Classification Search
CPC ..... D06F 58/10; D06F 29/00; D06F 73/02; D06F 39/008; D06F 39/081; D06F 34/42; D06F 33/47; D06F 39/087; D06F 33/54
See application file for complete search history.

(56) References Cited

U.S. PATENT DOCUMENTS 8,122,742 B2 * 2/2012 Park ..... D06F 39/008 68/15
8,209,805 B2 * 7/2012 Park ..... D06F 35/006 8/149.3
2005/0034489 A1 * 2/2005 Oh ..... D06F 39/008 68/5 C
2008/0115293 A1 * 5/2008 Park ..... D06F 39/008 8/158
2009/0007797 A1 * 1/2009 Ando ..... A21B 3/04 99/330
2009/0038084 A1 * 2/2009 Lee ..... D06F 35/006 8/149.1

(Continued)

FOREIGN PATENT DOCUMENTS

DE 102011102878 B4 * 10/2014 ..... F22B 35/00
EP 2191056 A2 6/2010

(Continued)

*Primary Examiner* — Kevin G Lee
(74) *Attorney, Agent, or Firm* — Dentons US LLP

(57) ABSTRACT

A clothes treating apparatus includes a case with a treatment chamber for holding clothes, a steam unit supplying steam to the treatment chamber, a blowing unit drawing in air from the inside of the treatment chamber, a heat pump unit heating the air drawn in by the blowing unit and discharging the heated air to the inside of the treatment camber, and a control unit controlling the steam unit, the blowing unit, and the heat pump unit, wherein when the heat pump unit is driven after the steam unit is driven, the control unit supplies water to the steam unit after the driving of the heat pump unit terminates.

20 Claims, 7 Drawing Sheets

(56) References Cited

U.S. PATENT DOCUMENTS

| | | | | |
|---|---|---|---|---|
| 2009/0126421 | A1 | 5/2009 | Kim et al. | |
| 2010/0058544 | A1* | 3/2010 | Park | D06F 33/00 8/149.3 |
| 2010/0107886 | A1* | 5/2010 | Xiao | D06F 75/12 99/281 |
| 2012/0246839 | A1 | 10/2012 | Park et al. | |
| 2016/0177500 | A1* | 6/2016 | Yoon | D06F 87/00 68/5 C |

FOREIGN PATENT DOCUMENTS

| | | | |
|---|---|---|---|
| EP | 3034679 | A1 | 6/2016 |
| KR | 100172867 | B1 | 5/1999 |
| KR | 1020080003021 | A | 1/2008 |
| KR | 1020110067890 | A | 6/2011 |

* cited by examiner

CLOTHES TREATING APPARATUS

CROSS-REFERENCE TO RELATED APPLICATION

Pursuant to 35 U.S.C. § 119(a), this application claims the benefit of earlier filing date and right of priority to Korean Application No. 10-2017-0048719, filed on Apr. 14, 2017, the contents of which is incorporated by reference herein in its entirety.

BACKGROUND

1. Field

The present disclosure relates to a clothes treating apparatus.

2. Background of the Disclosure

A clothes treating apparatus includes every apparatus for managing or treating clothes such as washing, drying, wrinkle elimination, and the like, of clothes or bedding at homes and laundries, For example, a clothes treating apparatus includes a washing machine for washing clothes, a dryer for drying clothes, a washer-dryer supporting both a washing function and a drying function, a refresher for refreshing clothes, an iron for eliminating unnecessary wrinkles of clothes or creating required wrinkles, or a steamer for eliminating unnecessary wrinkles of clothes.

The refresher, an apparatus for refreshing clothes, serves to dry clothes, supply fragrance to clothes, prevent generation of static electricity of clothes, or eliminate wrinkles of clothes.

The steamer is an apparatus for simply eliminating wrinkles of clothes by supplying steam to the clothes. Unlike a general iron, a hot plate thereof is not in contact with clothes, the steamer finely eliminates wrinkles of clothes The clothes treating apparatus supporting both functions of the refresher and the steamer may serve to eliminate wrinkles and odor of clothes received therein using steam and hot moving air. Through those functions, clothes received in the clothes treating apparatus may obtain an ironing effect as odor particles contaminating the clothes are eliminated or wrinkles are eliminated.

Recently, a washing machine having a steam generator, in particular, a drum-type washing machine, has become prevalent. That is, steam is supplied to laundry before or after washing or during washing to increase a washing effect through a sterilization function, a time reduction, acceleration of activation of a detergent, and the like.

The present disclosure relates to a refresher and a steamer among clothes treating apparatuses described above, but is not limited thereto.

In general, a steamer of a clothes treating apparatus has a tank for accommodating water to generate steam, and a water level sensor sensing a water level is provided in the tank. For example, the water level sensor is configured as at least one electrode, and a control unit of the clothes treating apparatus senses information related to a water level within the tank using a current flowing in the electrode.

As the number of uses of the steamer is increased, impurities gather within the tank, degrading the accuracy of the water level sensor. That is, in cases where a control unit of the clothes treating apparatus determines whether to supply water to the steamer using only the water level sensor provided in the tank, a problem may arise in which water in the tank, accommodating water to generate steam, may overflow or water in the tank is insufficient.

In particular, in cases where a water level of the tank is erroneously detected to be high although water of the tank is insufficient, water is not supplied to the tank, and thus, heat for generating steam may be applied to the tank without water. In this case, a heater generating heat applied to the tank may be broken down.

Meanwhile, in order to enhance accuracy of the water level sensor, manufacturing cost of the clothes treating apparatus is increased. Also, since the tank is installed within the clothes treating apparatus and has a structure not allowing a user to easily open it, it is difficult to remove impurities collected within the tank as the number of uses of the clothes treating apparatus is increased. As a result, performance of the water level sensor is not easy to enhance.

SUMMARY

Therefore, an aspect of the detailed description is to provide a clothes treating apparatus performing a control algorithm capable of complementing malfunction of a water level sensor, and a control method thereof.

Another aspect of the detailed description is to provide a clothes treating apparatus performing a control algorithm capable of preventing water, a material for generating steam, from overflowing from a tank, and a control method thereof.

Another aspect of the detailed description is to provide a clothes treating apparatus performing a control algorithm capable of preventing application of heat to a tank, which is to accommodate water as a material for generating steam, when the tank does not have water, and a control method thereof.

Another aspect of the detailed description is to provide a clothes treating apparatus capable of preventing breakdown of a heater for generating steam, without increasing a manufacturing cost of the clothes treating apparatus, and a control method thereof.

To achieve these and other advantages and in accordance with the purpose of this specification, as embodied and broadly described herein, a clothes treating apparatus may include: a case including a treatment chamber for holding clothes; a steam unit supplying steam to the treatment chamber; a blowing unit intaking air from the inside of the treatment chamber; a heat pump unit heating the air taken in by the blowing unit and discharging the heated air to the inside of the treatment camber; and a control unit controlling the steam unit, the blowing unit, and the heat pump unit, wherein when the heat pump unit is driven after the steam unit is driven, the control unit supplies water to the steam unit after the driving of the heat pump unit terminates.

According to another embodiment of the present disclosure, after driving of the steam unit and driving of the heat pump unit sequentially terminate, the control unit may sense an amount of water remaining in the steam unit and supplies water to the steam unit on the basis of a sensing result.

According to another embodiment of the present disclosure, after driving of the steam unit and driving of the heat pump unit sequentially terminate, when an amount of water remaining in the steam unit is determined to be equal to or greater than a predetermined value, the control unit may determine that the amount of water remaining in the steam unit was erroneously sensed.

According to another embodiment of the present disclosure, when it is determined that the amount of water remaining in the steam unit was erroneously sensed, the control unit may supply water to the steam unit on the basis of an amount of steam generated by the steam unit before the amount of water remaining in the steam unit was sensed.

The clothes treating apparatus may further include: a water supply pump supplying water to the steam unit; and a water supply valve provided to a flow channel connected to an inlet of the water supply pump, wherein when it is determined that an amount of water remaining in the steam unit was erroneously sensed, the control unit may control the water supply pump and the water supply valve to supply water to the steam unit on the basis of an amount of steam generated by the steam unit before the amount of steam remaining in the steam unit was sensed.

According to another embodiment of the present disclosure, when it is determined that an amount of water remaining in the steam unit was erroneously sensed, the control unit may open the water supply valve, and when a preset period of time has elapsed since the water supply valve was opened, the control unit may drive the water supply pump.

According to another embodiment of the present disclosure, the control unit may set a first limitation driving time on the basis of a time during which the steam unit is driven before the amount of water remaining in the steam unit was sensed, and when the driving time of the water supply pump exceeds the first limitation driving time, the control unit may stop the water supply pump.

According to another embodiment of the present disclosure, the steam unit may include: a water supply tank storing water for generating steam; a heater heating water stored in the water supply tank; and a water level sensor sensing a water level of the water supply tank.

According to another embodiment of the present disclosure, the water level sensor may include a first water level sensor and a second water level sensor, the sensors having different lengths, and when both the first and second water level sensors sense water after driving of the steam unit and driving of the heat pump unit sequentially terminate, the control unit may process a sensing result from the water level sensor, as an error.

According to another embodiment of the present disclosure, when the sensing result from the water level sensor is processed as an error, the control unit may supply water to the steam unit on the basis of an amount of steam generated by the steam unit before the amount of water remaining in the steam unit was sensed.

According to another embodiment of the present disclosure, the clothes treating apparatus may further include: a display unit outputting information related to a state of the clothes treating apparatus, wherein the control unit may calculate the number of times the sensing result from the water level sensor is processed as an error, and when the calculated number of times exceeds a limitation number, the control unit may control the display unit to output an error message.

According to another embodiment of the present disclosure, the control unit may calculate the number of times the sensing result from the water level sensor is processed as an error, and when the calculated number of times exceeds a limitation number, the control unit may stop an operation of the clothes treating apparatus and drain water remaining in the water supply tank.

According to another embodiment of the present disclosure, when draining of water remaining in the water supply tank is completed, the control unit may re-supply a preset amount of water to the water supply tank.

According to another embodiment of the present disclosure, after driving of the steam unit and driving of the heat pump unit sequentially terminate, when an amount of water remaining in the steam unit is equal to or smaller than a predetermined value, the control unit may supply water to the steam unit until the amount of water remaining in the steam unit exceeds the predetermined value.

According to another embodiment of the present disclosure, the clothes treating apparatus may further include: a water supply pump supplying water to the steam unit, wherein the control unit may drive the water supply pump during a preset second limitation driving time to supply water to the steam unit.

According to another embodiment of the present disclosure, the clothes treating apparatus may perform a pre-steam operation to heat water remaining in the steam unit; a steam operation to supply steam to the treatment chamber using heated water; and a dry operation to supply heated air to the treatment chamber.

According to another embodiment of the present disclosure, after the dry operation is completed, the control unit may determine whether the steam operation was performed before the dry operation was performed.

According to another embodiment of the present disclosure, when it is determined that the steam operation was performed before the dry operation was performed, the control unit may supply water to the steam unit.

According to another embodiment of the present disclosure, when it is determined that the steam operation was performed before the dry operation was performed, the control unit may detect information related to a water level of the steam unit, and when the detected water level of the steam unit is determined to exceed a predetermined water level value, the control unit may determine that the water level of the steam unit was erroneously sensed.

According to another embodiment of the present disclosure, the control unit may supply water to the steam unit on the basis of an amount of steam generated by the steam operation performed before the water level of the steam unit was erroneously sensed.

According to another embodiment of the present disclosure, the control unit may supply water to the steam unit on the basis of a time during which the steam operation was performed before the water level of the steam unit was erroneously sensed.

As described above, since the clothes treating apparatus according to the present disclosure is equipped with the control algorithm for complementing erroneous sensing of the water level sensor, an amount of water remaining in the tank may be accurately sensed without using an extra sensor.

Also, according to the present disclosure, since water is forcibly supplied to the tank regardless of a sensing result from the water level sensor after the steam function is performed, application of heat to the tank without water may be prevented.

Also, according to the present disclosure, since the control algorithm is performed such that heat is not applied to the tank without water, breakdown of the heat applying heat to the tank to generate steam may be prevented.

Also, according to the present disclosure, overflow of water from tank may be prevented by adjusting an amount of water supplied to the tank in consideration of a time during which the steam function is performed.

Also, according to the present disclosure, since breakdown of the clothes treating apparatus due to erroneous sensing of the water level sensor is prevented without using any extra sensor, manufacturing cost of the clothes treating apparatus may not be increased and the user of the clothes treating apparatus may save cost incurred due to breakdown.

Also, according to the present disclosure, when it is determined that the water level sensor erroneously operates a plurality of times, a message related to the erroneous operation is sent to the user, and thus, breakdown of the clothes treating apparatus may be prevented in advance.

Further scope of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Description will now be given in detail of the exemplary embodiments, with reference to the accompanying drawings. For the sake of brevity with reference to the drawings, the same or equivalent components will be provided with the same reference numbers, and description thereof will not be repeated.

Hereinafter, a clothes treating apparatus and a control method thereof according to embodiments of the present disclosure will be described with reference to the accompanying drawings.

Figure 1:
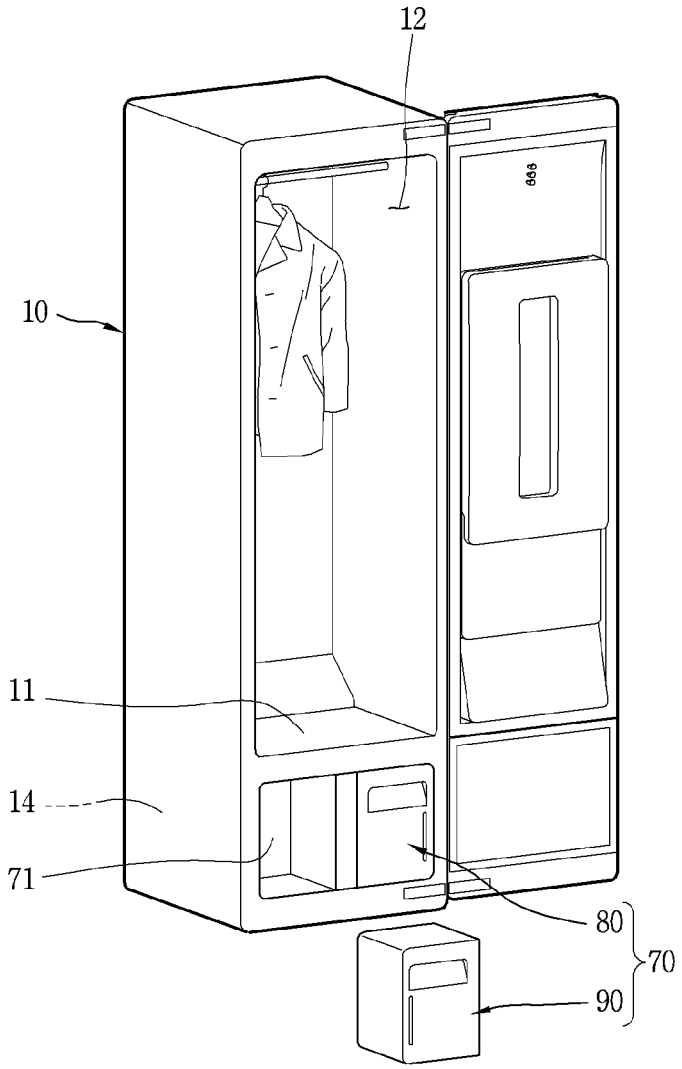
FIG. 1 is a perspective view of a clothes treating apparatus according to an embodiment of the present disclosure.
Figure 2:
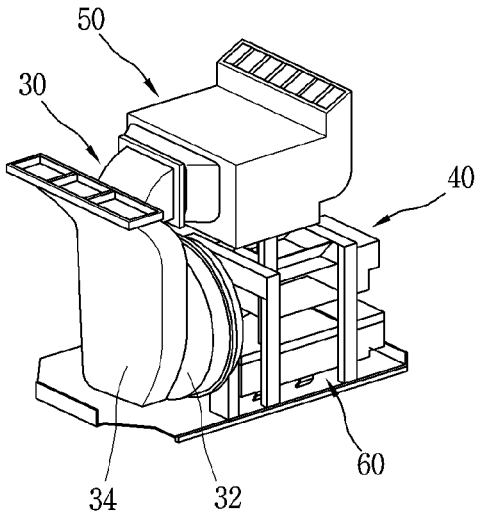
FIG. 2 is a perspective view of a some components of the clothes treating apparatus illustrated in FIG. 1.
Figure 3:
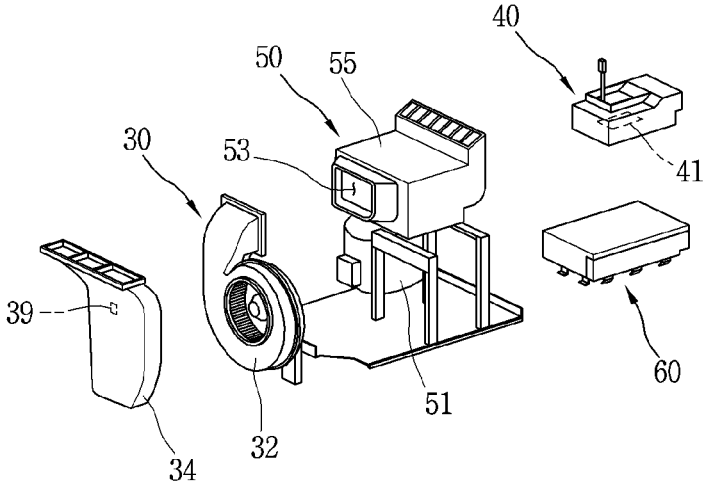
FIG. 3 is an exploded perspective view of some components of the clothes treating apparatus illustrated in FIG. 1.
Figure 4:
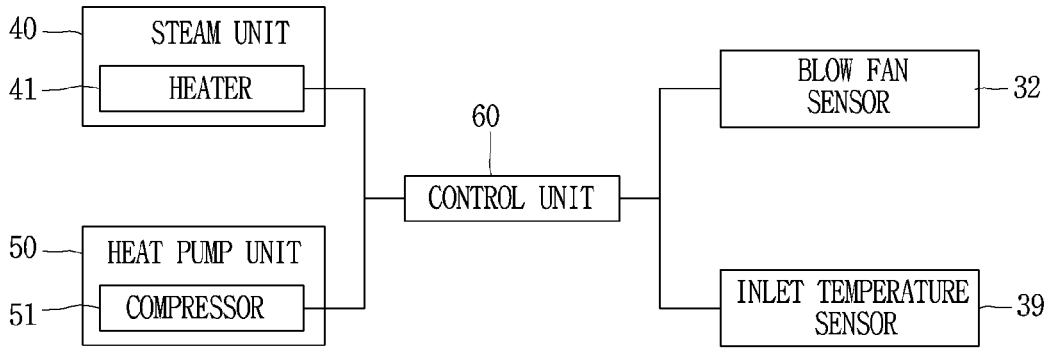
FIG. 4 is a block diagram of the clothes treating apparatus illustrated in FIG. 1.

FIG. 1 is a perspective view of a clothes treating apparatus according to an embodiment of the present disclosure; FIG. 2 is a perspective view of some components of the clothes treating apparatus illustrated in FIG. 1; FIG. 3 is an exploded perspective view of some components of the clothes treating apparatus illustrated in FIG. 1; and FIG. 4 is a block diagram of the clothes treating apparatus illustrated in FIG. 1.

The clothes treating apparatus according to an embodiment of the present disclosure includes a case 10 including a treatment chamber 12 for holding clothes, a steam unit 40 for supplying steam to the treatment chamber 12, a blowing unit 30 for intaking air from the inside of the treatment chamber 12, an inlet temperature sensor 39 measuring an inlet temperature of air entering the blowing unit 30, a heat pump unit 50 for heating air drawn in by the blowing unit 30 and discharging heated air to the treatment chamber 12, and a control unit 60 controlling the steam unit 40, the blowing unit 30, and the heat pump unit 50.

Case 10 has a separator 11 dividing the inside of the case 10 vertically. Treatment chamber 12 for holding clothes is provided above the separator 11 and a cycle chamber 14 in which a mechanical device is installed is provided below the separator 11.

The case has a door opening and closing a front side of the case 10.

The treatment chamber 12 holds clothes where wrinkles are removed or clothes are deodorized through steaming, air circulation, drying, and the like.

Installed in the cycle chamber 14, blowing unit 30 draws in air from the inside of the treatment chamber 12 and circulates the air, steam unit 40 supplies steam to treatment chamber 12, heat pump unit 50 supplies heated air to treatment chamber 12, and control unit 60 controls units 30, 40, and 50.

Blowing unit 30 intakes air from the inside of the treatment chamber 12 under the control of control unit 60. Air drawn into blowing unit 30 is discharged to heat pump unit 50.

Blowing unit 30 includes a blowing fan module 32 moving air through rotation of a fan to intake air from the inside of the treatment chamber 12 and subsequently discharge the air to heat pump unit 50 and an inlet duct 34 installed on an intaking side of the blowing fan module 32 for guiding air within the treatment chamber 12 to blowing fan module 32.

One side of inlet duct 34 is connected to treatment chamber 12 and the other side thereof is connected to blowing fan module 32. The inlet temperature sensor 39 measures an inlet temperature value of air moving within the inlet duct 34 and is provided within the inlet duct 34 and transfers the measured inlet temperature to control unit 60.

One side of blowing fan module 32 is connected to inlet duct 34, and the other side thereof is connected to heat pump unit 50. Blowing fan module 32 is a single module including a fan (e.g., a sirocco fan), a duct, and a motor.

Steam unit 40 supplies steam to treatment chamber 12 under the control of control unit 60. Steam unit 40 is heated by power applied thereto, receives water stored in a storage tank and heats the received water to convert the water into steam.

Steam generated by steam unit 40 is discharged to treatment chamber 12. In the present embodiment, steam generated by the steam unit 40 moves to treatment chamber 12 through a flow channel of the heat pump unit 50. That is, steam unit 40 is preferably connected to heat pump unit 50.

Steam unit 40 includes a heater 41 heating water. Steam unit 40 performs preheating to first heat heater 41 and subsequently generates steam under the control of control unit 60.

Heat pump unit 50 heats air drawn in by the blowing unit 30 and discharges the heated air to the inside of treatment chamber 12 under the control of control unit 60.

Heat pump unit 50 is configured as a refrigerating cycle including a compressor 51, a condenser 53, an evaporator (not shown), and an expansion valve (not shown), and includes a heat pump flow channel 55, in which the condenser 53 is installed, forming a flow channel.

Compressor 51 compresses a refrigerant to a high temperature and high pressure state. Condenser 53 heat-exchanges the refrigerant compressed in compressor 51 with air from the blowing unit 30 to heat air. The expansion valve expands the refrigerant condensed in the condenser, and the evaporator evaporates the refrigerant expanded in the expansion valve to collect the refrigerant by compressor 51.

One side of the heat pump flow channel 55 is connected to blowing fan module 32 of blowing unit 30, and the other side thereof is connected to treatment chamber 12. Condenser 53 is disposed within the heat pump flow channel 55.

A tank module 70 storing water is installed in front of cycle chamber 14, and in the present embodiment, a tank module frame 71 in which the tank module 70 is installed is installed in front of inlet duct 34.

Tank module 70 includes a storage tank 80 storing water to be supplied to steam unit 40 and a drain tank 90 collecting and storing condensate generated in the treatment chamber 12. Storage tank 80 is connected to steam unit 40 to supply water, and drain tank 90 is connected to treatment chamber 12 and stores water condensed in the treatment chamber 12 or the heat pump unit 50.

Control unit 60 receives an inlet temperature from the inlet temperature sensor 39. Control unit 60 performs each operation to treat clothes in the clothes treating apparatus according to a preset course by controlling steam unit 40, blowing unit 30, and heat pump unit 50 according to a user setting or an inlet temperature. Each operation to treat clothes will be described with reference to FIG. 5 hereinafter.

Control unit 60 controls an operation of heat pump unit 50 on the basis of a preheating inlet temperature measured by the inlet temperature sensor 39 by operating the blowing unit 30, while preheating the steam unit 40.

Figure 5:
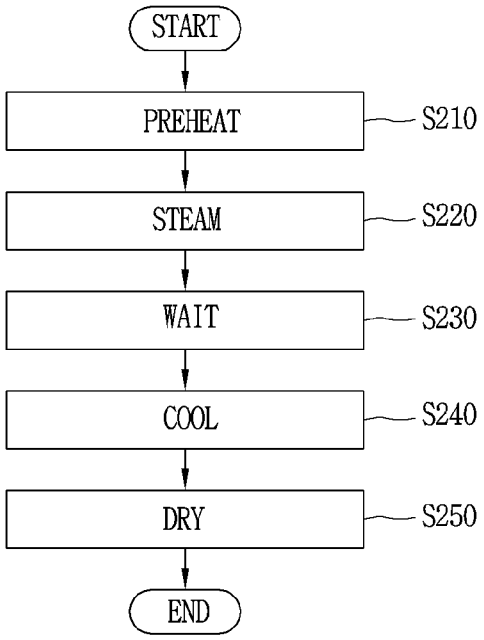
FIG. 5 is a flow chart illustrating an operation of a clothes treating apparatus according to an embodiment of the present disclosure.

FIG. 5 is a flow chart illustrating an operation of a clothes treating apparatus according to an embodiment of the present disclosure.

In FIG. 5, operations of a general course are illustrated, and some of operations may be omitted or the order of the operations may be interchanged.

When a user starts to operate the clothes treating apparatus, control unit 60 performs a preheating operation to preheat heater 41 of steam unit 40 by supplying power to the heater 41 (S210).

In the preheating operation (S210), control unit 60 operates the blowing fan module 32 of blowing unit 30. When blowing fan module 32 operates, the inlet temperature sensor 39 measures the temperature of air drawn into the inlet duct 34 of blowing unit 30 and transfers the measured preheating inlet temperature to control unit 60.

When preheating of heater 41 is completed, control unit 60 performs a steam operation (S220). Control unit 60 supplies water stored in storage tank 80 to steam unit 40 to generate steam, and supplies steam to the inside of treatment chamber 12. Control unit 60 operates the blowing fan module 32 to circulate air within treatment chamber 12. During the steam operation (S220), heat pump unit 50 does not operate.

When a preset period of time has elapsed, control unit 60 stops operation of steam unit 40 to terminate the steam operation (S220).

After the steam operation (S220), control unit 60 performs a standby operation (or waiting operation) (S230) and a cooling operation (S240). After the operation of steam unit 40 is stopped, control unit 60 performs the standby operation (S230) such that steam may be sufficiently applied to the clothes, while rotating blowing fan module 32 at a relatively low RPM.

When a preset period of time has elapsed, control unit 60 performs a cooling operation (S240) to decrease the temperature within treatment chamber 12, while rotating blowing fan module 32 at a relatively high RPM.

When a preset period of time has elapsed, control unit 60 terminates the cooling operation (S240).

After the cooling operation (S240), control unit 60 performs a dry operation (S250) to supply heated air to the inside of treatment chamber 12 by driving blowing fan module 32 and driving compressor 51 of heat pump unit 50.

Hereinafter, components of steam unit 40 will be described in detail with reference to FIGS. 6A to 6D.

Figure 6A:
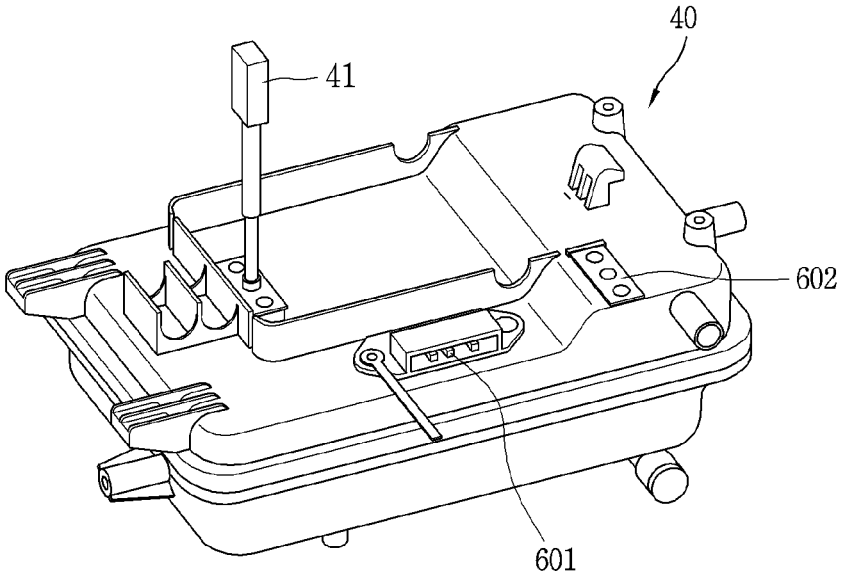
FIGS. 6A to 6D are views illustrating components of a clothes treating apparatus according to an embodiment of the present disclosure.
Figure 6B:
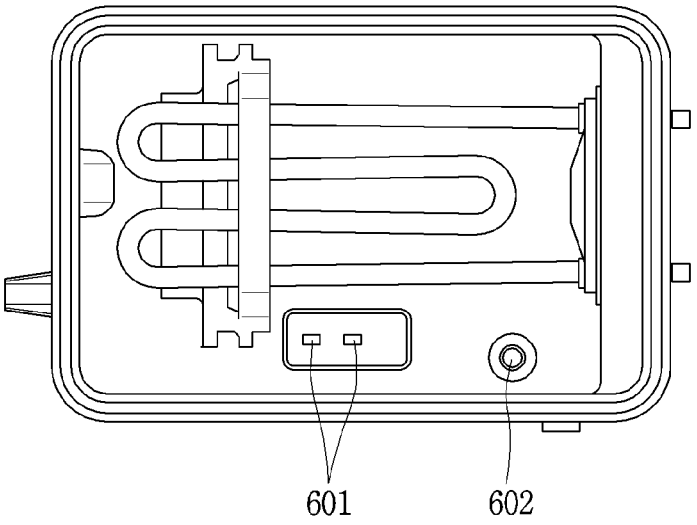
Figure 6C:
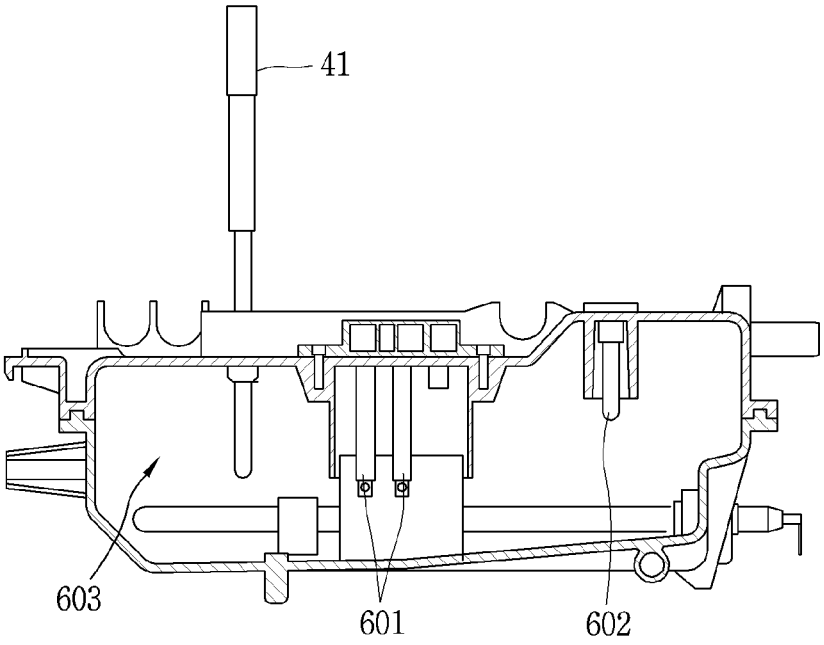

As illustrated in FIGS. 6A to 6C, steam unit 40 may include a water supply tank 603 accommodating water for generating steam, heater 41 heating water accommodated in water supply tank 603, and water level sensors 601 and 602 sensing a water level of the water supply tank.

Referring to FIG. 6C, the water level sensors may include a first water level sensor 601 and a second water level sensor 602. A length of the first water level sensor 601 may be different from that of the second water level sensor 602.

That is, the first and second water level sensors 601 and 602 may have different lengths. The first and second water level sensors 601 and 602 may sense contact with water remaining in the water supply tank, and the control unit of the clothes treating apparatus may detect information related to a water level of the water supply tank according to sensing results from the first and second water level sensors 601 and 602 on the basis of information related to lengths of the first and second water level sensors 601 and 602.

For example, the first water level sensor 601 and the second water level sensor 602 may be an electrode sensor, and when a portion of the electrode sensor is in contact with water, a current may flow in the electrode sensor.

In detail, referring to FIG. 6C, the first and second water level sensors 601 and 602 are provided at an upper portion of the water supply tank and installed to face a bottom part. First water level sensor 601 may be longer than second water level sensor 602, and thus, first water level sensor 601 may contact water at a lower level than the second water level sensor 602.

Hereinafter, when the water level sensor is determined to be in contact with water, it is defined that the water level sensor is ON. Conversely, when the water level sensor is determined not to be in contact with water, it is defined that the water level sensor is OFF.

In one embodiment, when the first and second water level sensors 601 and 602 are OFF, control unit 60 may determine that a water level of the water supply tank is low. Also, when the first water level sensor 601 is ON and the second water level sensor 602 is OFF, the control unit 60 may determine that a water level of the water supply tank is low.

Also, when the first and second water level sensors 601 and 602 are ON, the control unit 60 may determine that a water level of the water supply tank is high.

Meanwhile, when the first water level sensor 601 is OFF and the second water level sensor 602 is ON, control unit 60 may determine that information related to a water level of the water supply tank is detected to be erroneous.

Figure 6D:
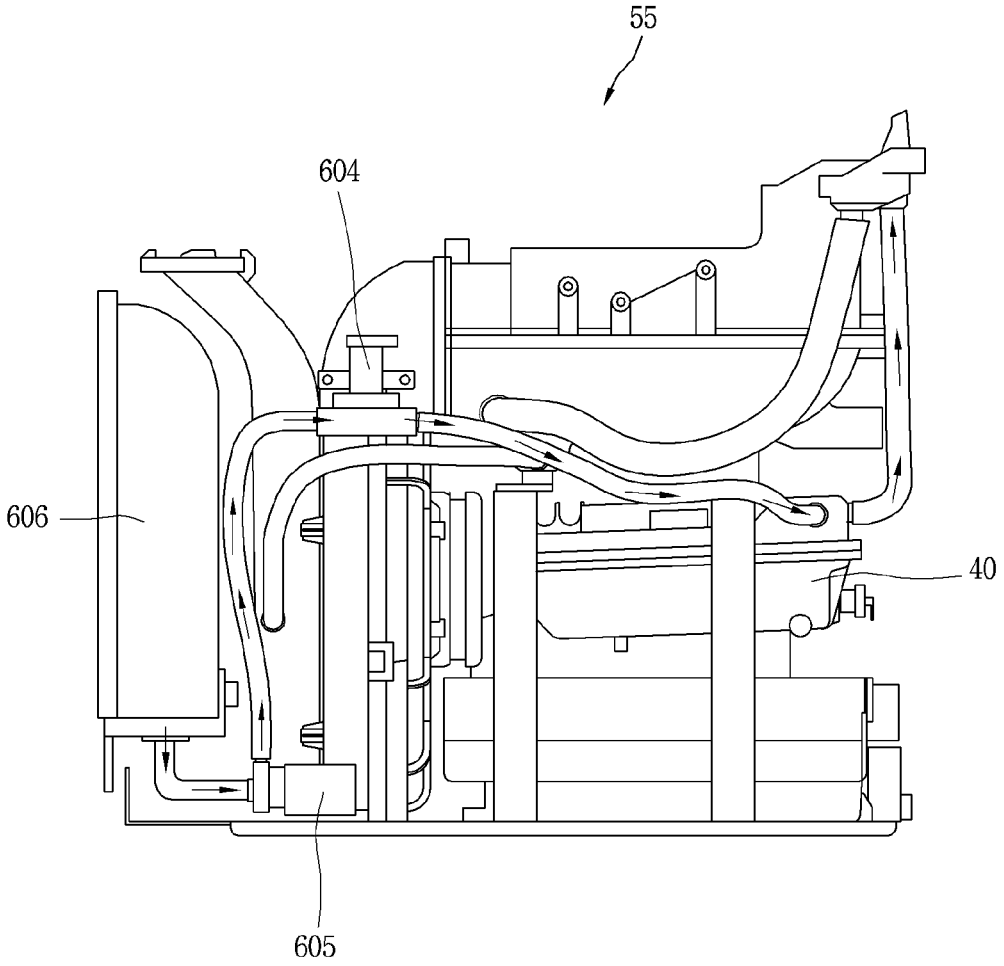

In FIG. 6D, components of the clothes treating apparatus connected to the steam unit 40 are illustrated.

A water supply valve 604, a water supply pump 605, and a water tank 606 may be connected to a flow channel transferring water to steam unit 60.

First, water supply valve 604 may be opened or closed on the basis of an electrical signal generated by control unit 60.

Water tank 606 may temporarily store water before transferring water to steam unit 40. Also, water supply pump 605 may generate driving force to supply water to steam unit 40.

Control unit 60 may adjust an amount of water supplied to the water supply tank by controlling at least one of an operation time of the water supply pump 605 and an opening time of the water supply valve 604.

In one embodiment, control unit 60 of the clothes treating apparatus according to the present disclosure may detect whether steam unit 40 was driven during an operation performed in a previous cycle, and determine whether a result of sensing by the water level sensor is erroneous on the basis of a detection result.

For example, when both the first and second water level sensors are ON although the steam unit 40 was driven in a previous operation, control unit 60 may determine that a result of sensing by the water level sensor is erroneous.

Also, in another example, when only the second water level sensor is ON although steam unit 40 was driven in a previous operation, control unit 60 may determine that a result of sensing by the water level sensor is erroneous.

In detail, when heat pump unit 50 is driven after steam unit 40 is driven, control unit 60 may supply water to steam unit 40 after driving of heat pump unit 50 terminates.

That is, after driving of steam unit 40 and driving of heat pump unit 50 sequentially terminate, control unit 60 may detect an amount of water remaining in steam unit 40. Additionally, control unit 60 may supply water to steam unit 40 on the basis of the sensing result.

After driving of steam unit 40 and driving of heat pump unit 50 sequentially terminate, when it is determined that an amount of water remaining in steam unit 40 is equal to or greater than a predetermined value, control unit 60 may determine that the amount of water remaining in steam unit 40 was erroneously sensed.

Here, after driving of steam unit 40 and driving of heat pump unit 50 sequentially terminate, when both the first and second water level sensors 601 and 602 are ON or when only the second water level sensor 602 is ON, control unit 60 may determine that an amount of water remaining in steam unit 40 was erroneously sensed.

When it is determined that the amount of water remaining in the steam unit 40 was erroneously sensed, control unit 60 may supply water to steam unit 40 on the basis of an amount of steam generated by steam unit 40 before sensing an amount of water remaining in steam unit 40.

When it is determined that an amount of water remaining in steam unit 40 was erroneously sensed, control unit 60 may control water supply pump 605 and water supply valve 604 to supply water to steam unit 40 on the basis of an amount of steam generated by steam unit 40 before sensing an amount of water remaining in steam unit 40.

When it is determined that an amount of water remaining in steam unit 40 was erroneously sensed, control unit 60 may open water supply valve 604, and when a preset period of time has elapsed since water supply valve 604 was opened, control unit 60 may drive the water supply pump. Here, for example, the preset period of time may be 3 seconds.

Control unit 60 may set a first limitation driving time on the basis of a time during which steam unit 40 was driven before sensing an amount of water remaining in steam unit 40. Also, when the driving time of water supply pump 605 exceeds the first limitation driving time, control unit 60 may stop water supply pump 605.

For example, the first limitation driving time may be a value obtained by multiplying a preset constant $\alpha$ to a time during which the steam unit 40 was driven in an immediately previous operation.

Control unit 60 may set the constant $\alpha$ using data related to a driving time of steam unit 40, an amount of water evaporated in the steam unit 40, a driving time of water supply pump 605, and an amount of water supplied by the water supply pump 605.

Control unit 60 may set the constant $\alpha$ such that 85% of an amount of water evaporated in a steam operation of a previous stage is supplied to the steam unit 40. Here, the value 85% is set according to experiment, and when control unit 60 supplies 85% of the amount of water evaporated in the steam operation of a previous stage to the steam unit 40, overflow of water from the water supply tank of steam unit 40 may be prevented.

Meanwhile, after driving of the steam unit 40 and driving of the heat pump unit 50 sequentially terminate, when water is sensed in both of the first and second water level sensors 601 and 602, control unit 60 may process the result of sensing by the water level sensors, as an error.

In an example, control unit 60 may set a count variable for calculating an error number of the water level sensors to 0 at an initial stage, and whenever a result of sensing by the water level sensors is processed as an error, the control unit 60 may increase the count variable by 1 each time.

When the result of sensing by the water level sensors is processed as an error, control unit 60 may control the water supply pump and the water supply valve to supply water to steam unit 40 on the basis of an amount of steam generated by the steam unit 40 before sensing an amount of water remaining in steam unit 40.

Meanwhile, although not shown, the clothes treating apparatus according to the present disclosure may include a display unit (not shown) for outputting information related to a state of the clothes treating apparatus.

In one embodiment, control unit 60 may calculate the number of times a sensing result of the water level sensor was processed as an error, and when the calculated number exceeds a limitation number, control unit 60 may control the display unit to output an error message. Here, for example, the limitation number may be 5 times.

Also, in another embodiment, control unit 60 may calculate the number of times a sensing result of the water level sensor was processed as an error, and when the calculated number exceeds a limitation number, control unit 60 may stop the operation of the clothes treating apparatus and drain the water remaining in the water supply tank.

In another embodiment, when draining of water remaining in the water supply tank is completed, control unit 60 may control the water supply valve and the water supply pump to re-supply a preset amount of water to the water supply tank. The preset amount of water may be 80% of capacity of the water supply tank.

Meanwhile, after driving of the steam unit and driving of the heat pump unit 50 sequentially terminate, when it is determined that an amount of water remaining in the steam unit is equal to or smaller than a predetermined value, control unit 60 may supply water to the steam unit until the amount of water remaining in the steam unit exceeds the predetermined value.

For example, after driving of steam unit 40 and driving of heat pump unit 50 sequentially terminate, when the first water level sensor 601 is ON and the second water level sensor 602 is OFF, control unit 60 may determine that the amount of water remaining in the steam unit 40 is equal to or smaller than the predetermined value.

In this case, control unit 60 may supply water to steam unit 40 until the second water level sensor 602 is turned on. Also, control unit 60 may drive the water supply pump within a preset second limitation time ($\beta$ seconds) to supply water to steam unit 40. In this manner, by setting the second limitation driving time, overflow of water from the water tank due to malfunction of the second water level sensor may be prevented.

In another embodiment, control unit 60 of the clothes treating apparatus according to the present disclosure may perform a pre-steam operation to heat water remaining in the steam unit 40, a steam operation to supply steam to the treatment chamber using heated water, and a dry operation to supply heated air to the treatment chamber.

After completing the dry operation, control unit 60 may determine whether the steam operation was performed before the dry operation was performed.

When it is determined that the steam operation was performed before the dry operation was performed, control unit 60 may supply water to the steam unit.

More specifically, when it is determined that the steam operation was performed before the dry operation was performed, control unit 60 may detect information related to a water level of steam unit 40. When it is determined that a water level of the steam unit exceeds a predetermined water level value, control unit 60 may determine that the water level of steam unit 40 was erroneously sensed.

Control unit 60 may supply water to steam unit 40 on the basis of an amount of steam generated during the steam operation performed before the water level of the steam unit 40 was erroneously sensed.

Control unit 60 may supply water to steam unit 40 on the basis of a time during which the steam operation was performed before the water level of the steam unit 40 was erroneously sensed.

Hereinafter, a method for controlling a clothes treating apparatus according to the present disclosure will be described with reference to FIG. 7.

Control unit 60 may control heat pump unit 50 to perform a dry operation (S701).

When the dry operation is completed, control unit 60 may determine whether the steam operation is performed before the dry operation (S702).

When it is determined that the steam operation is performed before the dry operation, control unit 60 may sense a water level of the water supply tank using a sensing result from the water level sensor provided in the steam unit 40 (S703).

Here, control unit 60 may determine whether the second water level sensor is ON (S704). When the second water level sensor is ON, control unit 60 may determine that a water level of the water supply tank was erroneously sensed, and perform an algorithm to cope with the erroneous sensing.

Meanwhile, control unit 60 may detect a time during which the steam operation was performed before the dry operation, and determine whether the time during which the steam operation was performed exceeds a preset period of time. Also, only when the time during which the steam operation was performed exceeds the preset period of time, control unit 60 may perform the algorithm to cope with the erroneous sensing.

For example, in cases where the steam operation immediately before the dry operation was performed for 3 minutes or less, control unit 60 may not perform the algorithm to cope with the erroneous sensing and determine whether to supply water to the water supply tank on the basis of a sensing result from the water level sensor.

Figure 7:
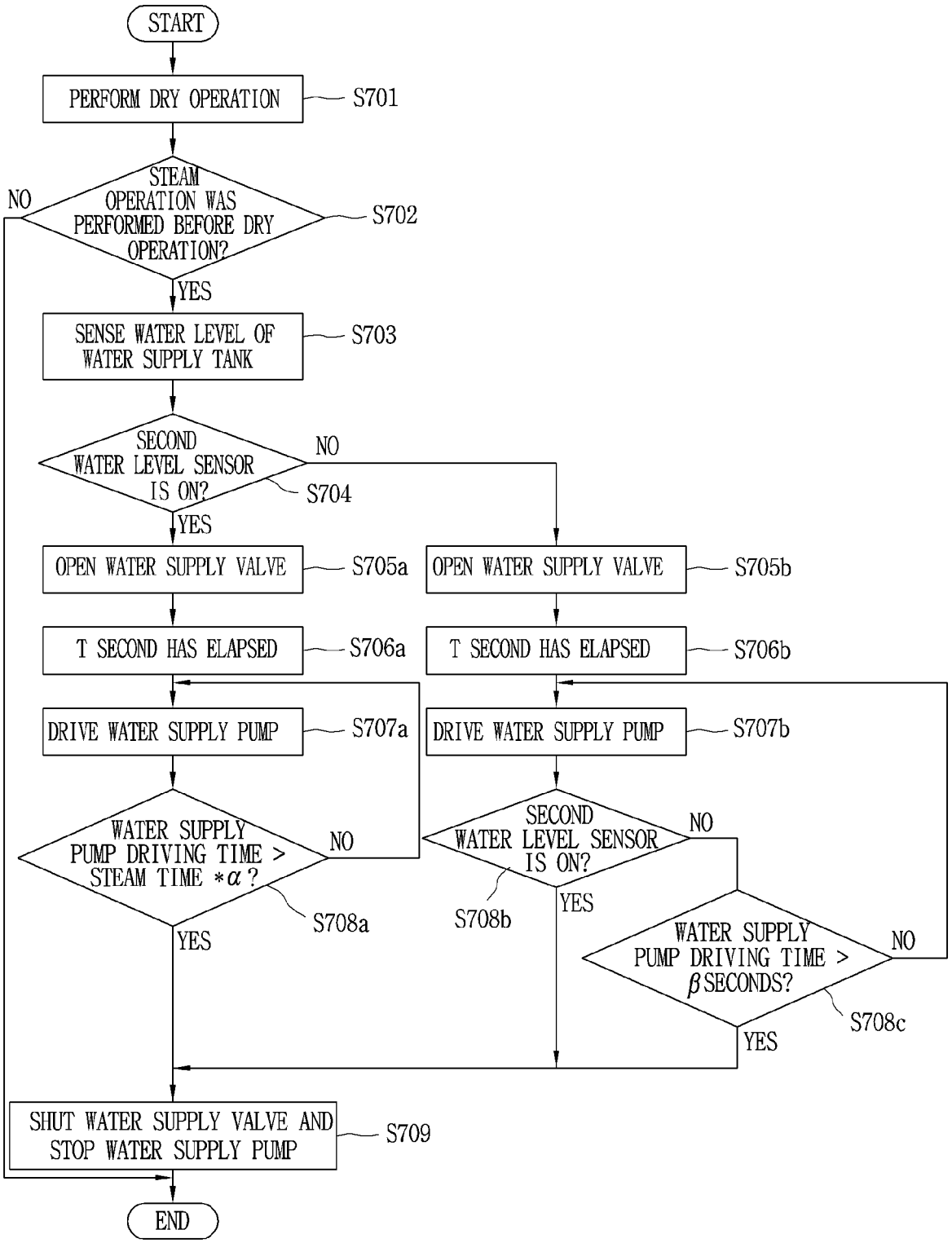
FIG. 7 is a flow chart illustrating a control method of a clothes treating apparatus according to an embodiment of the present disclosure.

Referring to FIG. 7, control unit 60 opens the water supply valve (S705*a*), and after a predetermined period of time (t seconds) has elapsed (S706*a*), control unit 60 may drive the water supply pump (S707*a*).

More specifically, control unit 60 may determine whether a driving time of the water supply pump exceeds a time value obtained by multiplying a preset constant, α, to the time during which the steam operation was maintained previously (S708*a*).

When the driving time of the water supply pump exceeds the time value obtained by multiplying the preset constant, α, to the time during which the steam operation was maintained previously, control unit 60 may shut the water supply valve and stop the water supply pump (S709).

Meanwhile, when it is determined that the second water level sensor is OFF, control unit 60 may perform a general water supply algorithm.

That is, control unit 60 opens the water supply valve (S705*b*), and after the lapse of a predetermined period of time (t seconds) (S706), control unit 60 may drive the water supply pump (S707*b*).

Additionally, control unit 60 may determine whether the second water level sensor is switched to ON, while the water supply pump is being driven (S708*b*).

Also, control unit 60 may determine whether a driving time of the water supply pump exceeds a second limitation driving time (β seconds) (S708*c*).

When the second water level sensor is switched to ON or when the driving time of the water supply pump exceeds the second limitation driving time (β seconds), control unit 60 may shut the water supply valve and stop the water supply pump (S709).

As described above, since the clothes treating apparatus according to the present disclosure is equipped with the control algorithm for complementing erroneous sensing of the water level sensor, an amount of water remaining in the tank may be accurately sensed without using an extra sensor.

Also, according to the present disclosure, since water is forcibly supplied to the tank regardless of a sensing result from the water level sensor after the steam function is performed, application of heat to the tank without water may be prevented.

Also, according to the present disclosure, since the control algorithm is performed such that heat is not applied to the tank without water, breakdown of the heat applying heat to the tank to generate steam may be prevented.

Also, according to the present disclosure, overflow of water from tank may be prevented by adjusting an amount of water supplied to the tank in consideration of a time during which the steam function is performed.

Also, according to the present disclosure, since breakdown of the clothes treating apparatus due to erroneous sensing of the water level sensor is prevented without using any extra sensor, manufacturing cost of the clothes treating apparatus may not be increased and the user of the clothes treating apparatus may save cost incurred due to breakdown.

Also, according to the present disclosure, when it is determined that the water level sensor erroneously operates a plurality of times, a message related to the erroneous operation is sent to the user, and thus, breakdown of the clothes treating apparatus may be prevented in advance.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus comprising:

a case including a treatment chamber for holding clothes;

a steam unit supplying steam to the treatment chamber;

a blowing unit drawing in air from the inside of the treatment chamber;

a heat pump unit heating the air and discharging the heated air to the inside of the treatment camber;

a water level sensor sensing a water level of the water supply tank;

a water supply pump supplying water to the steam unit; and a control unit is programmed to control the steam unit, the blowing unit, the heat pump unit, the water level sensor, and the water supply pump, wherein the control unit is further programmed such that if an amount of water remaining in the steam unit is determined to be equal to or greater than a predetermined value, when the heat pump unit is driven after the steam unit, the control unit supplies water to the steam unit.

2. The clothes treating apparatus of claim 1, wherein, after the driving of the steam unit and the driving of the heat pump unit sequentially terminate, the control unit determines the amount of water remaining in the steam unit and supplies water to the steam unit on the basis of a determining result.

3. The clothes treating apparatus of claim 2, wherein, after the driving of the steam unit and the driving of the heat pump unit sequentially terminate, when the amount of water remaining in the steam unit is determined to be equal to or greater than the predetermined value, the control unit determines that the amount of water remaining in the steam unit was erroneously determined.

4. The clothes treating apparatus of claim 3, wherein, when it is determined that the amount of water remaining in the steam unit was erroneously determined, the control unit supplies water to the steam unit on the basis of the amount of steam generated by the steam unit before the amount of water remaining in the steam unit was determined.

5. The clothes treating apparatus of claim 4, further comprising:

a water supply valve provided to a flow channel connected to an inlet of the water supply pump, wherein when it is determined that an amount of water remaining in the steam unit was erroneously determined, the control unit controls the water supply pump and the water supply valve to supply water to the steam unit on the basis of an amount of steam generated by the steam unit before the amount of steam remaining in the steam unit was determined.

6. The clothes treating apparatus of claim 5, wherein, when it is determined that the amount of water remaining in the steam unit was erroneously determined, the control unit opens the water supply valve, and when a preset period of time has elapsed since the water supply valve was opened, the control unit drives the water supply pump.

7. The clothes treating apparatus of claim 6, wherein the control unit sets a first limitation driving time on the basis of a time during which the steam unit is driven before the amount of water remaining in the steam unit was determined, and when the driving time of the water supply pump exceeds the first limitation driving time, the control unit stops the water supply pump.

8. The clothes treating apparatus of claim 2, wherein the steam unit includes:

a water supply tank storing water for generating steam; and a heater heating water stored in the water supply tank.

9. The clothes treating apparatus of claim 8, wherein the water level sensor includes a first water level sensor and a second water level sensor, the sensors having different lengths, and when both the first and second water level sensors determine water after the driving of the steam unit and the driving of the heat pump unit sequentially terminate, the control unit processes the determining result from the water level sensor as an error.

10. The clothes treating apparatus of claim 9, wherein, when the determining result from the water level sensor is processed as an error, the control unit supplies water to the steam unit on the basis of an amount of steam generated by the steam unit before the amount of water remaining in the steam unit was determined.

11. The clothes treating apparatus of claim 9, wherein the control unit calculates the number of times the sensing result from the water level sensor is processed as an error, and when the calculated number of times exceeds a limitation number, the control unit stops an operation of the clothes treating apparatus and drains the water remaining in the water supply tank.

12. The clothes treating apparatus of claim 9, wherein, when the draining of the water remaining in the water supply tank is completed, the control unit re-supplies a preset amount of water to the water supply tank.

13. The clothes treating apparatus of claim 1, further comprising:

a display unit outputting information related to a state of the clothes treating apparatus, wherein the control unit calculates the number of times the determining result from the water level sensor is processed as an error, and when the calculated number of times exceeds a limitation number, the control unit controls the display unit to output an error message.

14. The clothes treating apparatus of claim 1, wherein, after the driving of the steam unit and the driving of the heat pump unit sequentially terminate, when the amount of water remaining in the steam unit is equal to or smaller than the predetermined value, the control unit supplies water to the steam unit until the amount of water remaining in the steam unit exceeds the predetermined value.

15. The clothes treating apparatus of claim 1, further comprising:

a water supply pump supplying water to the steam unit, wherein the control unit drives the water supply pump during a preset second limitation driving time to supply water to the steam unit.

16. The clothes treating apparatus of claim 1, wherein the clothes treating apparatus performs:

a pre-steam operation to heat water remaining in the steam unit;

a steam operation to supply steam to the treatment chamber using heated water; and a dry operation to supply heated air to the treatment chamber.

17. The clothes treating apparatus of claim 16, wherein, after the dry operation is completed, the control unit determines whether the steam operation was performed before the dry operation was performed.

18. The clothes treating apparatus of claim 17, wherein, when it is determined that the steam operation was performed before the dry operation was performed, the control unit supplies water to the steam unit.

19. The clothes treating apparatus of claim 18, wherein, when it is determined that the steam operation was performed before the dry operation was performed, the control unit detects information related to a water level of the steam unit, and when the detected water level of the steam unit is determined to exceed a predetermined water level value, the control unit determines that the water level of the steam unit was erroneously determined.

20. The clothes treating apparatus of claim 19, wherein the control unit supplies water to the steam unit on the basis of an amount of steam generated by the steam operation performed before the water level of the steam unit was erroneously determined.

* * * * *